US009916812B2

(12) United States Patent
Oh et al.

(10) Patent No.: US 9,916,812 B2
(45) Date of Patent: Mar. 13, 2018

(54) DISPLAY APPARATUS INCLUDING SYNCHRONIZED TIMING CONTROLLERS AND A METHOD OF OPERATING THE DISPLAY APPARATUS

(71) Applicant: SAMSUNG DISPLAY CO., LTD., Yongin-si, Gyeonggi-Do (KR)

(72) Inventors: Kwan-Young Oh, Hanam-si (KR); Sil-Yi Bang, Yongin-si (KR); Kyoung-Won Lee, Seoul (KR); Jae-Ho Choi, Seoul (KR); Sangsu Han, Hanam-si (KR); Jung-Hwan Cho, Asan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/132,788

(22) Filed: Apr. 19, 2016

(65) Prior Publication Data

US 2017/0098431 A1 Apr. 6, 2017

(30) Foreign Application Priority Data

Oct. 5, 2015 (KR) ..... 10-2015-0139761

(51) Int. Cl.

*G09G 3/36* (2006.01)
*G09G 5/12* (2006.01)
*G09G 3/20* (2006.01)

(52) U.S. Cl.

CPC ..... *G09G 5/12* (2013.01); *G09G 3/20* (2013.01); *G09G 3/2096* (2013.01); *G09G 3/3666* (2013.01); *G09G 2310/027* (2013.01); *G09G 2310/0221* (2013.01);

(Continued)

(58) Field of Classification Search

CPC ..... G09G 3/3666; G09G 5/12; G09G 3/20; G09G 3/2096

USPC ..... 345/103

See application file for complete search history.

(56) References Cited

U.S. PATENT DOCUMENTS

2010/0302214 A1* 12/2010 Kim ..... G09G 3/20 345/204
2012/0086681 A1* 4/2012 Kim ..... G09G 3/3648 345/204

(Continued)

FOREIGN PATENT DOCUMENTS

KR 1020070096914 10/2007
KR 1020110108844 10/2011

(Continued)

*Primary Examiner* — Adam J Snyder

(74) *Attorney, Agent, or Firm* — F. Chau & Associates, LLC

(57) ABSTRACT

A display apparatus includes a display panel, a first timing controller, a second timing controller and a third timing controller. The first timing controller controls an operation of a first region in the display panel, and generates a reference clock signal. The second timing controller controls an operation of a second region in the display panel, and receives the reference clock signal. The third timing controller controls an operation of a third region in the display panel, and receives the reference clock signal. The first, second and third timing controllers are synchronized with one another in response to the reference clock signal and a state synchronization signal, and operate in one of a plurality of states depending on an operation of the display apparatus.

20 Claims, 15 Drawing Sheets

(52) U.S. Cl.
CPC ..... *G09G 2310/0243* (2013.01); *G09G 2310/0294* (2013.01); *G09G 2310/08* (2013.01); *G09G 2360/06* (2013.01)

(56) References Cited

U.S. PATENT DOCUMENTS

| | | | | |
|---|---|---|---|---|
| 2012/0127145 | A1* | 5/2012 | Jang | G09G 3/20 345/211 |
| 2012/0154454 | A1* | 6/2012 | Ohishi | G09G 3/36 345/690 |
| 2013/0038597 | A1* | 2/2013 | Kim | G09G 3/3688 345/213 |
| 2013/0207944 | A1* | 8/2013 | Oohira | G09G 3/3685 345/204 |
| 2014/0028644 | A1* | 1/2014 | Sakai | G09G 3/3655 345/204 |
| 2014/0049533 | A1* | 2/2014 | Saitoh | G09G 3/20 345/213 |
| 2014/0085174 | A1* | 3/2014 | Inoue | G09G 3/2074 345/87 |
| 2014/0204065 | A1* | 7/2014 | Park | G09G 3/2033 345/204 |
| 2016/0125845 | A1* | 5/2016 | Oh | G09G 3/3666 345/214 |
| 2017/0098431 | A1* | 4/2017 | Oh | G09G 5/12 |

FOREIGN PATENT DOCUMENTS

| | | |
|---|---|---|
| KR | 1020120111583 | 10/2012 |
| KR | 10-2016-0053444 | 5/2016 |

* cited by examiner

DISPLAY APPARATUS INCLUDING SYNCHRONIZED TIMING CONTROLLERS AND A METHOD OF OPERATING THE DISPLAY APPARATUS

CROSS-REFERENCE TO RELATED APPLICATION

This application claims priority under 35 U.S.C. § 119 to Korean Patent Application No. 10-2015-0139761, filed on Oct. 5, 2015 in the Korean Intellectual Property Office (KIPO), the disclosure of which is incorporated by reference herein in its entirety.

TECHNICAL FIELD

Exemplary embodiments of the inventive concept relate to displaying images on a display apparatus, and more particularly to a display apparatus and a method of operating the display apparatus.

DISCUSSION OF RELATED ART

A display apparatus includes a display panel and a timing controller. The timing controller controls operations of the display panel. For example, the timing controller may control the display panel to display an image on the display panel.

As the size of display panels increases, calculations for controlling the display panel also increase. Distributing processing in the display apparatus may increase the performance of the display apparatus.

SUMMARY

According to exemplary embodiments of the inventive concept, a display apparatus includes a display panel, a first timing controller, a second timing controller and a third timing controller. The first timing controller controls an operation of a first region in the display panel, and generates a reference clock signal. The second timing controller controls an operation of a second region in the display panel, and receives the reference clock signal. The third timing controller controls an operation of a third region in the display panel, and receives the reference clock signal. The first, second and third timing controllers are synchronized with one another in response to the reference clock signal and a state synchronization signal. The first, second and third timing controllers operate in one of a plurality of states depending on an operation of the display apparatus.

In an exemplary embodiment of the inventive concept, when each of the first, second and third timing controllers operates in a first state, each of the first, second and third timing controllers may perform a first operation corresponding to the first state. When the first, second and third timing controllers complete the first operation, a state of each of the first, second and third timing controllers may change from the first state to a second state in response to the state synchronization signal.

In an exemplary embodiment of the inventive concept, when the first, second and third timing controllers complete the first operation, the state synchronization signal may be activated. When a first time interval is elapsed after the state synchronization signal is activated, the state of each of the first, second and third timing controllers may be changed from the first state to the second state. When a second time interval is elapsed after the state of the first, second and third timing controllers is changed from the first state to the second state, the state synchronization signal may be deactivated. The first time interval and the second time interval may be determined by the reference clock signal.

In an exemplary embodiment of the inventive concept, the reference clock signal may be shared by the first, second and third timing controllers in a broadcasting scheme. In the broadcasting scheme the reference clock signal is generated by one of the first, second and third timing controllers and transmitted to the other timing controllers.

In an exemplary embodiment of the inventive concept, the state synchronization signal may be shared by the first, second and third timing controllers by using a single bus, or the state synchronization signal may be relayed between two adjacent timing controllers.

In an exemplary embodiment of the inventive concept, the first timing controller may generate a first internal reference clock signal in response to the reference clock signal, and may generate a first synchronization clock signal in response to the first internal reference clock signal. The second timing controller may generate a second internal reference clock signal in response to the reference clock signal, and may generate a second synchronization clock signal in response to the second internal reference clock signal. The third timing controller may generate a third internal reference clock signal in response to the reference clock signal, and may generate a third synchronization clock signal in response to the third internal reference clock signal. The first, second and third timing controllers may exchange a plurality of information associated with the operation of the display apparatus with one another in response to the first, second and third synchronization clock signals.

In an exemplary embodiment of the inventive concept, the first timing controller may transmit first information of the plurality of information to the second and third timing controllers in response to the first synchronization clock signal.

In an exemplary embodiment of the inventive concept, the second timing controller may perform a data capture operation on the first information in response to the second internal reference clock signal. The third timing controller may perform the data capture operation on the first information in response to the third internal reference clock signal.

In an exemplary embodiment of the inventive concept, each of the first, second and third internal reference clock signals may have a frequency higher than a frequency of the reference clock signal. Each of the first, second and third synchronization clock signals may have a frequency lower than the frequency of each of the first, second and third internal reference clock signals. The data capture operation may include a multi-phase capture operation.

In an exemplary embodiment of the inventive concept, the third timing controller may transmit first information of the plurality of information to the first and second timing controllers in response to the third synchronization clock signal. The second timing controller may transmit second information of the plurality of information to the first and third timing controllers in response to the second synchronization clock signal. The first timing controller may transmit third information of the plurality of information to the second and third timing controllers in response to the first synchronization clock signal.

In an exemplary embodiment of the inventive concept, the first timing controller may transmit first information of the plurality of information to the second timing controller in response to the first synchronization clock signal. The second timing controller may transmit the first information and second information of the plurality of information to the third timing controller in response to the second synchronization clock signal.

In an exemplary embodiment of the inventive concept, the first, second and third synchronization clock signals may be shared by the first, second and third timing controllers by using a first bus, and the plurality of information may be shared by the first, second and third timing controllers by using a second bus, or at least one of the first, second and third synchronization clock signals and the plurality of information may be relayed between two adjacent timing controllers.

In an exemplary embodiment of the inventive concept, the first timing controller may operate as a master, the second timing controller may operate as a first slave, and the third timing controller may operate as a second slave.

In an exemplary embodiment of the inventive concept, the first timing controller may receive a first setting signal indicating the first timing controller is the master. The second timing controller may receive a second setting signal indicating the second timing controller is the first slave. The third timing controller may receive a third setting signal indicating the third timing controller is the second slave.

In an exemplary embodiment of the inventive concept, the first timing controller may be the master based on a first internal parameter. The second timing controller may be the first slave based on a second internal parameter. The third timing controller may be the second slave based on a third internal parameter.

In an exemplary embodiment of the inventive concept, the display apparatus may further include a fourth timing controller. The fourth timing controller may control an operation of a fourth region in the display panel, and may receive the reference clock signal. The fourth timing controller may operate in one of the plurality of states depending on the operation of the display apparatus. The fourth timing controller may be synchronized with the first, second and third timing controllers based on the reference clock signal and the state synchronization signal.

According to exemplary embodiments of the inventive concept, in a method of operating a display apparatus, first, second and third timing controllers are synchronized with each other by using a reference clock signal and a state synchronization signal. A display panel operates by using the first, second and third timing controllers. The first, second and third timing controllers control operations of first, second and third regions in the display panel, respectively, and operate in one of a plurality of states depending on an operation of the display apparatus.

In an exemplary embodiment of the inventive concept, synchronizing the first, second and third timing controllers with each other by using the state synchronization signal may include the following steps. When each of the first, second and third timing controllers are in a first state, a first operation corresponding to the first state may be performed by each of the first, second and third timing controllers. When the first, second and third timing controllers complete the first operation, a state of each of the first, second and third timing controllers may change from the first state to a second state by using the state synchronization signal.

In an exemplary embodiment of the inventive concept, changing the state of each of the first, second and third timing controllers may include the following steps. When the first, second and third timing controllers complete the first operation, the state synchronization signal may be activated. When a first time interval elapses after the state synchronization signal activates, the state of each of the first, second and third timing controllers may be changed from the first state to the second state. When a second time interval elapses after the state of each of the first, second and third timing controllers changes from the first state to the second state, the state synchronization signal may deactivate. The first time interval and the second time interval may be determined by the reference clock signal.

In an exemplary embodiment of the inventive concept, synchronizing the first, second and third timing controllers with each other by using the reference clock signal may include the following steps. The reference clock signal may be generated. A first, second and third internal reference clock signals may be generated by using the reference clock signal. A first, second and third synchronization clock signals may be generated by using the first, second and third internal reference clock signals. The first, second and third timing controllers may exchange a plurality of information associated with the operation of the display apparatus with each other by using the first, second and third synchronization clock signals. According to exemplary embodiments of the inventive concept, a display apparatus includes a plurality of timing controllers, a plurality of data drivers, a gate driver and a display panel. The plurality of timing controllers receives a plurality of image data and a plurality of image control signals. The plurality of data drivers generate a plurality of analog data voltages based on a plurality of output image data and a plurality of control signals received from the plurality of timing controllers. The gate driver generates gate signals based on a control signal received from a timing controller of the plurality of timing controllers. The display panel receives the analog data voltages and the gate signals. The plurality of timing controllers are configured to be synchronized with one another in response to a reference clock signal and on a state synchronization signal.

In an exemplary embodiment of the inventive concept, the plurality of timing controllers may operate in one of a plurality of states depending on an operation of the display apparatus.

In an exemplary embodiment of the inventive concept, the display apparatus may include a first, second and third timing controllers. The first, second and third timing controllers may be connected to a first, second and third data drivers respectively.

In an exemplary embodiment of the inventive concept, the first, second and third timing controllers may control a first, second and third regions of the display panel respectively.

In an exemplary embodiment of the inventive concept, the first, second and third timing controller may relay data between each other. The data may correspond to a boundary image displayed on a boundary region between two adjacent regions among the first, second and third region.

In an exemplary embodiment of the inventive concept, the display apparatus may include first, second, third and fourth timing controllers. The first, second, third and fourth timing controllers may be connected to a first, second, third and fourth data drivers respectively.

BRIEF DESCRIPTION OF THE DRAWINGS

Exemplary embodiments of the inventive concept will be more clearly understood from the following detailed description taken in conjunction with the accompanying drawings.

DETAILED DESCRIPTION OF THE EMBODIMENTS

Figure 1:
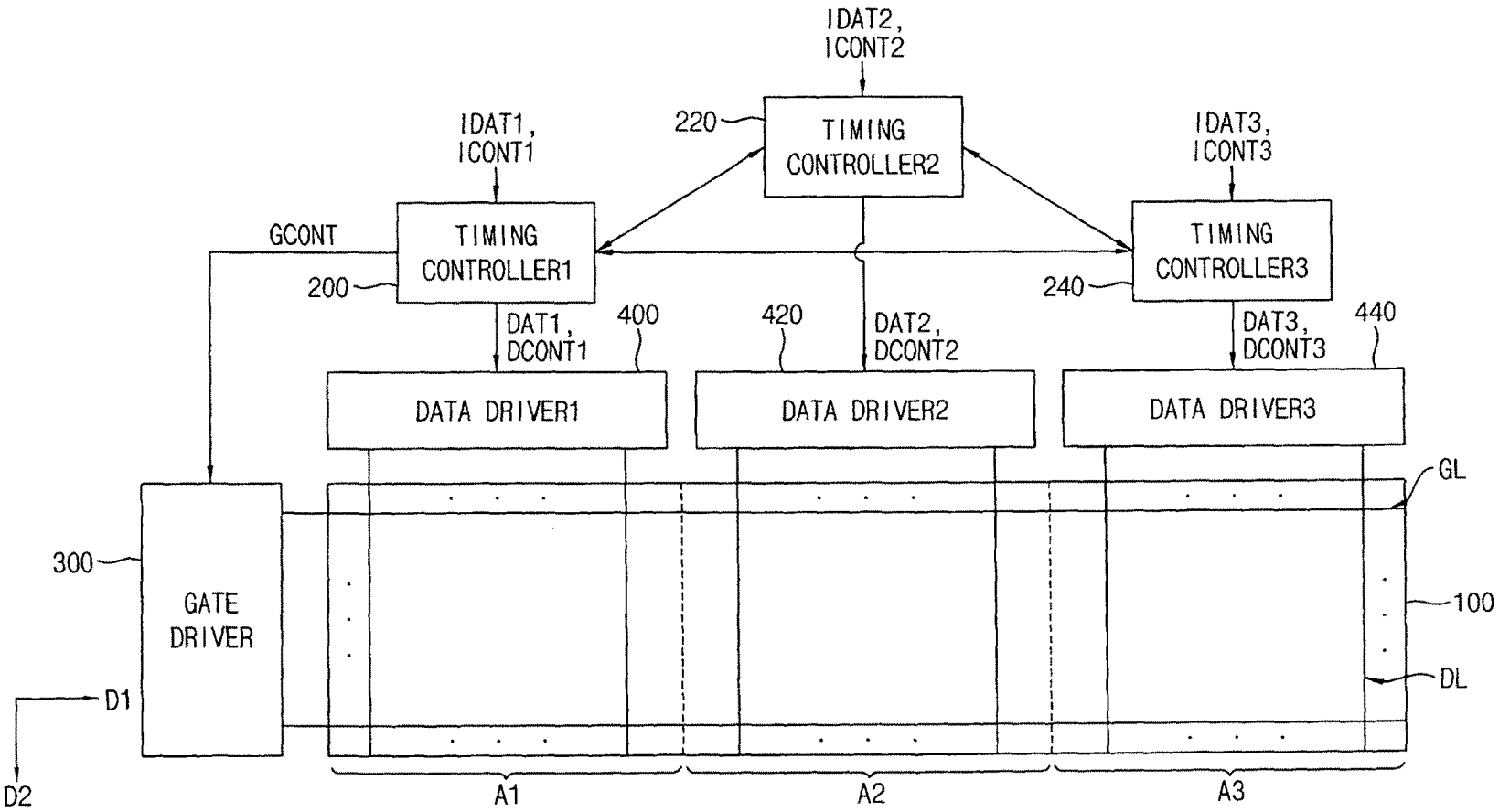
FIG. 1 is a block diagram illustrating a display apparatus according to an exemplary embodiment of the inventive concept.

Hereinafter, exemplary embodiments of the inventive concept will be described more fully with reference to the accompanying drawings. This inventive concept may, however, be embodied in many different forms and should not be construed as limited to the embodiments set forth herein. Like reference numerals may refer to like elements throughout this application.

FIG. 1 is a block diagram illustrating a display apparatus according to an exemplary embodiment of the inventive concept.

Referring to FIG. 1, a display apparatus 10 includes a display panel 100, first, second and third timing controllers 200, 220 and 240, a gate driver 300, and first, second and third data drivers 400, 420 and 440.

The display panel 100 operates (e.g., displays an image) based on first, second and third output image data DAT1, DAT2 and DAT3. The display panel 100 is connected to a plurality of gate lines GL and a plurality of data lines DL. The gate lines GL may extend in a first direction D1, and the data lines DL may extend in a second direction D2. The first direction D1 crosses the second direction D2. The first direction D1 may be substantially perpendicular to the second direction D2. The display panel 100 may include a plurality of pixels that are arranged in a matrix form. Each pixel may be electrically connected to a respective one of the gate lines GL and a respective one of the data lines DL.

In an exemplary embodiment of the inventive concept, the display panel 100 may be divided into a plurality of display regions. For example, the display panel 100 may include first, second and third regions A1, A2 and A3. Each of the regions A1, A2 and A3 in the display panel 100 may be controlled by a respective one of the timing controllers 200, 220 and 240 and a respective one of the data drivers 400, 420 and 440. The number of the regions in the display panel 100 and the arrangement of the regions can be changed.

The timing controllers 200, 220 and 240 control an operation of the display panel 100, the gate driver 300 and the data drivers 400, 420 and 440. The timing controllers 200, 220 and 240 receive first, second and third input image data IDAT1, IDAT2 and IDAT3, and first, second and third input control signals ICONT1, ICONT2 and ICONT3 from an external device (e.g., a host or a graphics processor). The input image data IDAT1, IDAT2 and IDAT3 may include a plurality of pixel data for the plurality of pixels. The input control signals ICONT1, ICONT2 and ICONT3 may include a master clock signal, a data enable signal, a vertical synchronization signal, a horizontal synchronization signal, etc.

The timing controllers 200, 220 and 240 generate the output image data DAT1, DAT2 and DAT3 based on the input image data IDAT1, IDAT2 and IDAT3. The first timing controller 200 generates a first control signal GCONT based on the first input control signal ICONT1. The first control signal GCONT may be provided to the gate driver 300, and a driving timing of the gate driver 300 may be controlled based on the first control signal GCONT. The first control signal GCONT may include a vertical start signal, a gate clock signal, etc. The timing controllers 200, 220 and 240 generate a second, third and fourth control signals DCONT1, DCONT2 and DCONT3 based on the input control signals ICONT1, ICONT2 and ICONT3. The second, third and fourth control signals DCONT1, DCONT2 and DCONT3 may be provided to the data drivers 400, 420 and 440. Driving timings of the data drivers 400, 420 and 440 may be controlled based on the second, third and fourth control signals DCONT1, DCONT2 and DCONT3. The second, third and fourth control signals DCONT1, DCONT2 and DCONT3 may include a horizontal start signal, a data clock signal, a data load signal, a polarity control signal, etc.

The gate driver 300 generates a plurality of gate signals for driving the gate lines GL based on the first control signal GCONT. The gate driver 300 may sequentially apply the gate signals to the gate lines GL. For example, the gate driver 300 may include a plurality of shift registers.

The data drivers 400, 420 and 440 generate a plurality of analog data voltages based on the second, third and fourth control signals DCONT1, DCONT2 and DCONT3 and the digital output image data DAT1, DAT2 and DAT3. The data drivers 400, 420 and 440 may sequentially apply the data voltages to the data lines DL. For example, each of the data drivers 400, 420 and 440 may include a shift register, a latch, a digital-to-analog converter, and an output buffer.

In an exemplary embodiment of the inventive concept, the gate driver 300 and/or the data drivers 400, 420 and 440 may be disposed, e.g., directly mounted, on the display panel 100, or may be connected to the display panel 100 in a tape carrier package (TCP) type. In an exemplary embodiment of the inventive concept, the gate driver 300 and/or the data drivers 400, 420 and 440 may be integrated in the display panel 100.

Figure 2:
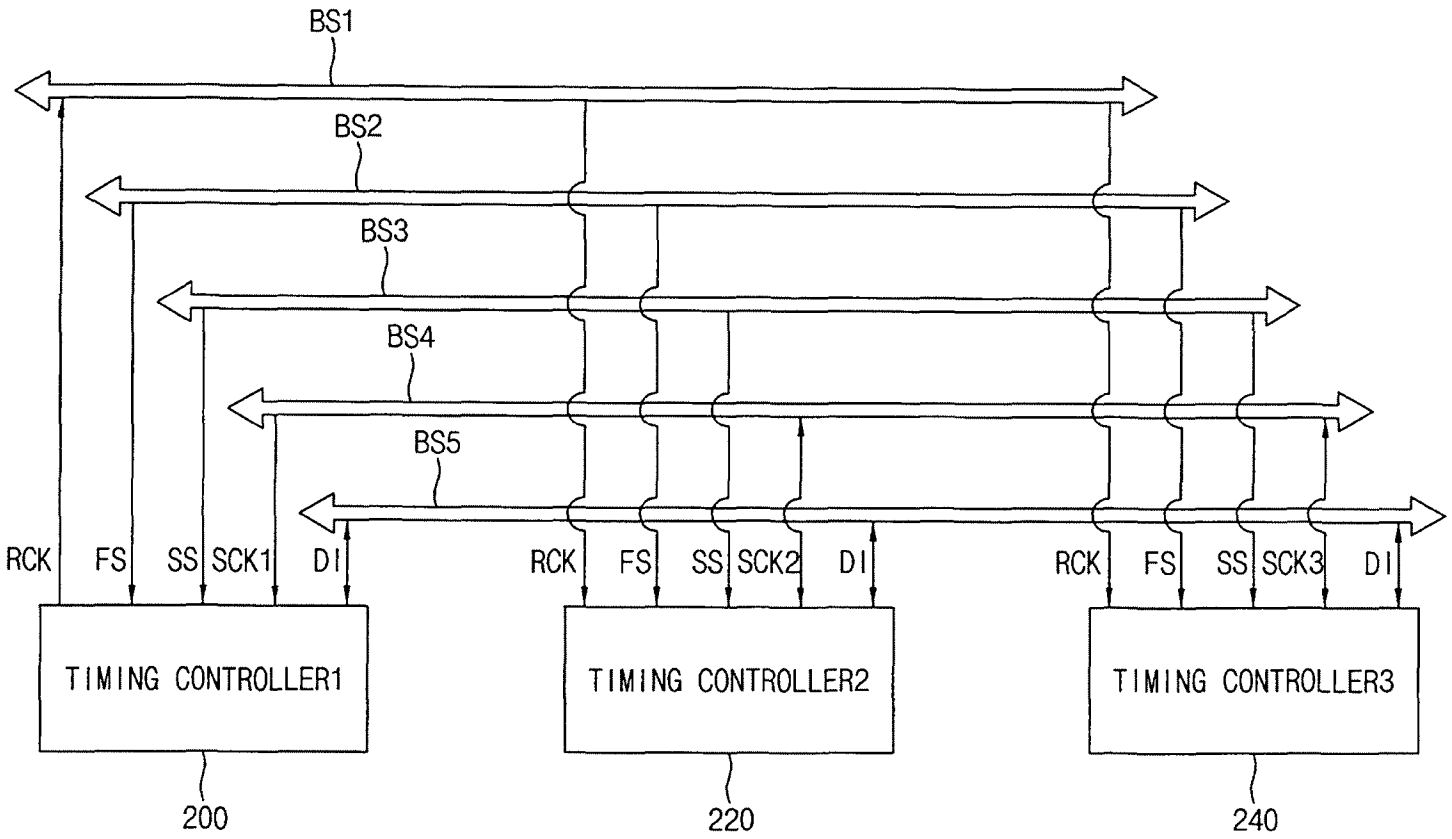
FIG. 2 is a block diagram illustrating timing controllers included in the display apparatus according to an exemplary embodiment of the inventive concept.

FIG. 2 is a block diagram illustrating the timing controllers included in the display apparatus according to an exemplary embodiment of the inventive concept.

FIG. 2 illustrates the synchronization of the timing controllers 200, 220 and 240 with one another. Some operations (e.g., operations for generating the output image data DAT1, DAT2 and DAT3 in FIG. 1, and the control signals GCONT, DCONT1, DCONT2, and DCONT3 in FIG. 1) of the timing controllers 200, 220 and 240 are omitted in FIG. 2 for convenience of illustration.

Referring to FIGS. 1 and 2, the first timing controller 200 generates a reference clock signal RCK. The second and third timing controllers 220 and 240 receive the reference clock signal RCK. The timing controllers 200, 220 and 240 are synchronized with one another based on the reference clock signal RCK. As will be described below, with reference to FIGS. 5, 6, 7, 8, 9 and 10, the timing controllers 200, 220 and 240 may exchange a plurality of information DI associated with an operation of the display apparatus 10 with one another based on first, second and third synchronization clock signals SCK1, SCK2 and SCK3. The first, second and third synchronization clock signals SCK1, SCK2 and SCK3 are generated based on the reference clock signal RCK.

The timing controllers 200, 220 and 240 are additionally synchronized with one another based on a state synchronization signal SS. As will be described below with reference to FIG. 3, the timing controllers 200, 220 and 240 operate in one of a plurality of states depending on the operation of the display apparatus 10. The timing controllers 200, 220 and 240 may perform a state change based on the state synchronization signal SS at substantially the same time. In a further exemplary embodiment of the inventive concept, each of the timing controllers 200, 220 and 240 may perform the state change close in time with at least one of others of the timing controllers 200, 220 and 240 based on the state synchronization signal SS.

In an exemplary embodiment of the inventive concept, the timing controllers 200, 220 and 240 may be additionally synchronized with one another based on a fail synchronization signal FS. The fail synchronization signal FS may indicate that at least one of the timing controllers 200, 220 and 240 enters a fail mode. The timing controllers 200, 220 and 240 may enter the fail mode based on the fail synchronization signal FS. In an exemplary embodiment of the inventive concept, the timing controllers 200, 220 and 240 may enter the fail mode simultaneously. In an exemplary embodiment of the inventive concept, each of the timing controllers 200, 220 and 240 may enter the fail mode close in time with at least one of others of the timing controllers 200, 220 and 240 based on the fail synchronization signal FS.

In an exemplary embodiment of the inventive concept, the first timing controller 200 may operate as a master, the second timing controller 220 may operate as a first slave, and the third timing controller 240 may operate as a second slave. In this example, the reference clock signal RCK may be shared by the timing controllers 200, 220 and 240 based on a broadcasting scheme in which the reference clock signal RCK generated by one timing controller (e.g., 200) is transmitted to other timing controllers (e.g., 220 and 240). In other words, the reference clock signal RCK may be shared by the timing controllers 200, 220 and 240 based on a single bus BS1.

In an exemplary embodiment of the inventive concept, the reference clock signal RCK, the state synchronization signal SS, the fail synchronization signal FS, the synchronization clock signals SCK1, SCK2 and SCK3, and the plurality of information DI may be shared by the timing controllers 200, 220 and 240. For example, the state synchronization signal SS may be shared by the timing controllers 200, 220 and 240 by using a single bus BS3. The fail synchronization signal FS may be shared by the timing controllers 200, 220 and 240 by using a single bus BS2. The synchronization clock signals SCK1, SCK2 and SCK3 may be shared by the timing controllers 200, 220 and 240 by using a single bus BS4. The plurality of information DI may be shared by the timing controllers 200, 220 and 240 by using a single bus BS5.

Figure 3:
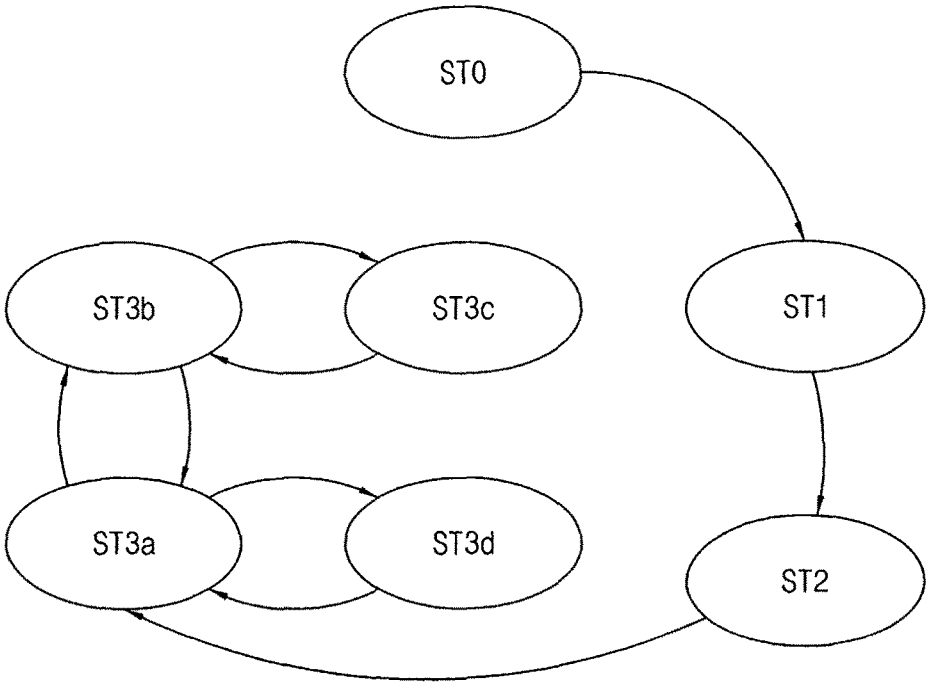
FIGS. 3 and 4 are diagrams for describing a synchronization of the timing controllers according to an exemplary embodiment of the inventive concept.
Figure 4:
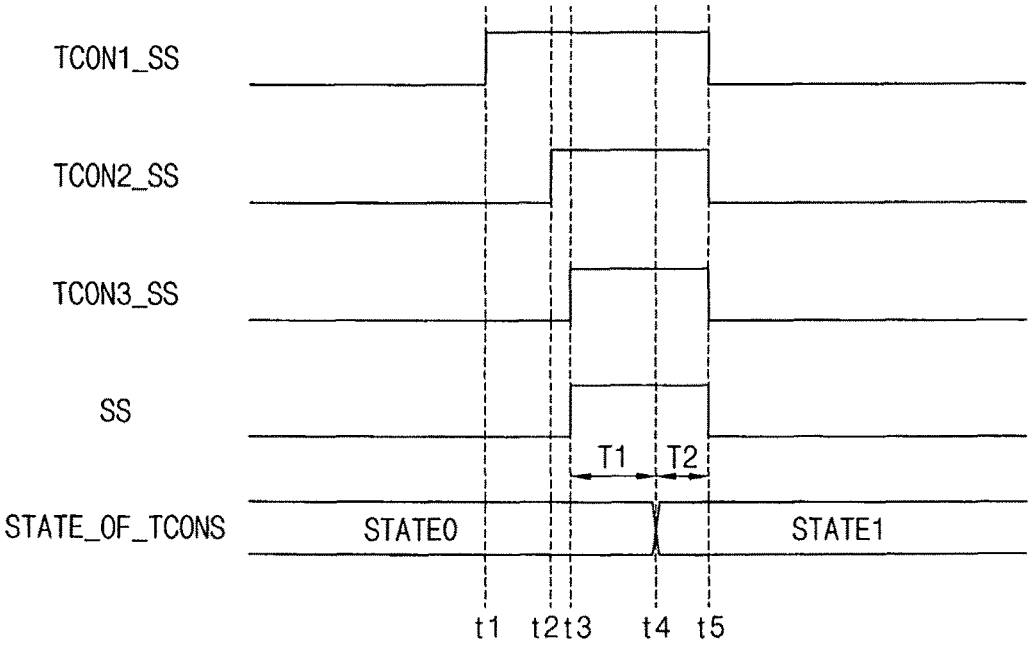

FIGS. 3 and 4 are diagrams for describing a synchronization of the timing controllers according to an exemplary embodiment of the inventive concept.

Referring to FIGS. 2 and 3, each of the timing controllers 200, 220 and 240 may operate in one of a plurality of states ST0, ST1, ST2, ST3*a*, ST3*b*, ST3*c* and ST3*d* depending on the operation of the display apparatus 10 of FIG. 1.

In an exemplary embodiment of the inventive concept, the state ST0 may represent a state immediately after the display apparatus 10 is powered on. In the state ST0, a first loading operation in which a plurality of initial setting values (e.g., parameters) are loaded into the timing controllers 200, 220 and 240 may be performed. The state ST1 may represent a state after the first loading operation is completed. In the state ST1, a first display operation in which a black image is displayed and a second loading operation in which a plurality of data (e.g., random access memory (RAM) data) associated with the operation of the display apparatus 10 are loaded into the timing controllers 200, 220 and 240 may be performed. The state ST2 may represent a state after the second loading operation is completed. In the state ST2, the timing controllers 200, 220 and 240 may perform a first display operation and may wait to receive input image data from the external device. The states ST3*a*, ST3*b* and ST3*c* may represent states after the input image data is received. In the states ST3*a*, ST3*b* and ST3*c*, a second display operation in which an image corresponding to the input image data is displayed may be performed. For example, in the state ST3*a*, an operation (e.g., a vertical synchronization) corresponding to a vertical black duration (V Black) may be performed. In the state ST3*b*, one horizontal line image corresponding to a single horizontal duration (1H) may be displayed. In the state ST3*c*, an operation (e.g., a horizontal synchronization) corresponding to a horizontal black duration (H Black) may be performed. The state ST3*d* may represent any state that is determined by a user and is associated with the operation of the display apparatus 10. In the state ST3*d*, an operation determined by the user may be performed.

Referring to FIGS. 2, 3 and 4, when each of the timing controllers 200, 220 and 240 operate in a first state (e.g., ST0) among the plurality of states ST0, ST1, ST2, ST3*a*, ST3*b*, ST3*c* and ST3*d*, each of the timing controllers 200, 220 and 240 may perform a first operation (e.g., the first loading operation) corresponding to the first state. When the timing controllers 200, 220 and 240 complete the first operation, a state of each of the timing controllers 200, 220 and 240 may be changed from the first state (e.g., ST0) to a second state (e.g., ST1) based on the state synchronization signal SS.

For example, at an initial operation time, each of the timing controllers 200, 220 and 240 operates in the first state and performs the first operation (e.g., STATE_OF_TCONS=STATE0). Until the first operation is completed, all pins (e.g., SYNC_D2 pins) that are associated with the state synchronization signal SS and in the timing controllers 200, 220 and 240 are driven to have a logic low level (e.g., TCON1_SS, TCON2_SS and TCON3_SS=logic low level).

At time t1, the first timing controller 200 completes the first operation, and the pin that is associated with the state synchronization signal SS and in the first timing controller 200 is released (e.g., TCON1_SS=HI-Z level). At time t2, the second timing controller 220 completes the first operation, and the pin that is associated with the state synchronization signal SS and in the second timing controller 220 is released (e.g., TCON2_SS=HI-Z level). At time t3, the third timing controller 240 completes the first operation, and the pin that is associated with the state synchronization signal SS and in the third timing controller 240 is released (e.g., TCON3_SS=HI-Z level). At time t3 at which all of TCON1_SS, TCON2_SS and TCON3_SS have the HI-Z level, the state synchronization signal SS is activated (e.g., SS=logic high level).

When a first time interval T1 is elapsed after the state synchronization signal SS is activated (e.g., at time t4), the state of each of the timing controllers 200, 220 and 240 is changed from the first state to the second state (e.g., STATE_OF_TCONS=STATE1). The first time interval T1 may be determined based on the reference clock signal RCK. For example, the first time interval T1 may be an integer multiple of a period of the reference clock signal RCK. In other words, T1=PRCK*M, where PRCK represents the period of the reference clock signal RCK and M is an integer. For example, M may be an integer greater than 0.

When a second time interval T2 is elapsed after the state of each of the timing controllers 200, 220 and 240 is changed from the first state to the second state (e.g., at time t5), all pins that are associated with the state synchronization signal SS and in the timing controllers 200, 220 and 240 are driven to have the logic low level (e.g., TCON1_SS, TCON2_SS and TCON3_SS=logic low level), and then the state synchronization signal SS is deactivated (e.g., SS=logic low level). The second time interval T2 may be determined based on the reference clock signal RCK. For example, the second time interval T2 may be an integer multiple of the period of the reference clock signal RCK. In other words, T2=PRCK*N, where N is an integer. For example, M may be an integer greater than 0.

In an exemplary embodiment of the inventive concept, the state synchronization signal SS may be deactivated based on a sum of the first and second time intervals T1 and T2 (e.g., not based on only the second time interval T2). For example, when a third time interval (T1+T2) is elapsed after the state synchronization signal SS is activated, the state synchronization signal SS may be deactivated. The third time interval (T1+T2) may be determined based on the reference clock signal RCK.

Although the states of the timing controllers 200, 220 and 240 and the synchronization of the timing controllers 200, 220 and 240 are described based on an example of FIGS. 3 and 4, the timing controllers 200, 220 and 240 can operate in one of various states. For example, the synchronization of the timing controllers 200, 220 and 240 can be performed based on one of the various states.

Figure 5:
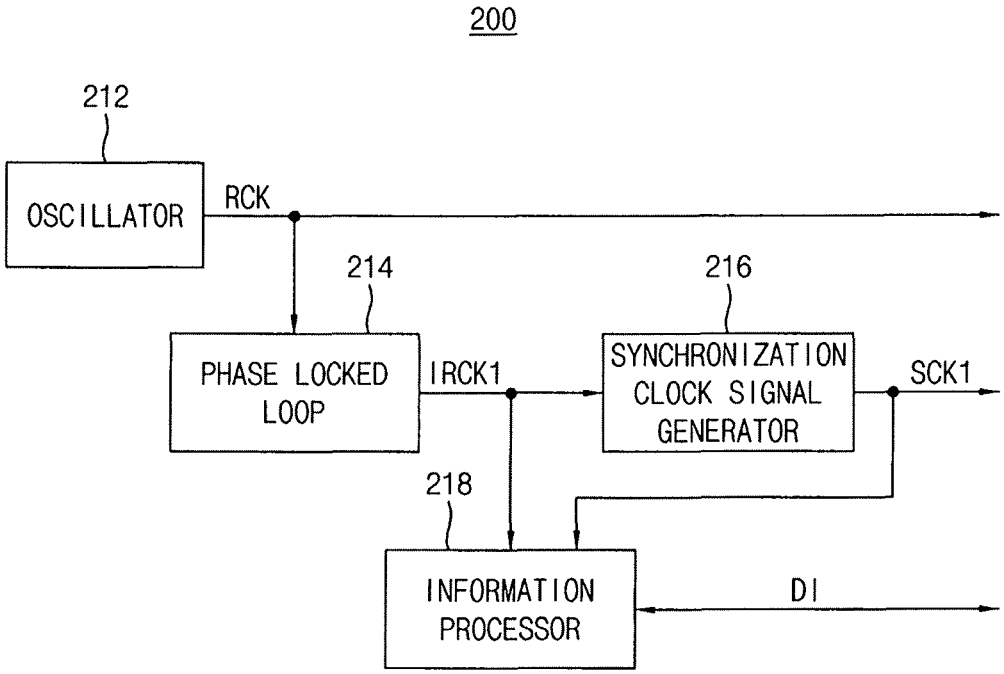
FIG. 5 is a block diagram illustrating a timing controller included in the display apparatus according to an exemplary embodiment of the inventive concept.

FIG. 5 is a block diagram illustrating a timing controller included in the display apparatus according to an exemplary embodiment of the inventive concept.

FIG. 5 illustrates an example of the first timing controller 200 and components in the first timing controller 200 for synchronizing the first timing controller 200 with the second and third timing controllers 220 and 240. Some components (e.g., components for generating the first output image data DAT1 in FIG. 1, and the first and second control signals GCONT and DCONT1 in FIG. 1) in the first timing controller 200 are omitted from FIG. 5 for convenience of illustration.

Referring to FIGS. 2 and 5, the first timing controller 200 may include a first oscillator 212, a first phase locked loop (PLL) 214, a first synchronization clock signal generator 216 and a first information processor 218.

The first oscillator 212 may generate the reference clock signal RCK. The reference clock signal RCK may be provided to the second and third timing controllers 220 and 240. The first PLL 214 may generate the first internal reference clock signal IRCK1 based on the reference clock signal RCK. The first synchronization clock signal generator 216 may generate the first synchronization clock signal SCK1 based on the first internal reference clock signal IRCK1. The first information processor 218 may perform a data processing operation for the plurality of information DI and/or a data capture operation on the plurality of information DI based on the first internal reference clock signal IRCK1 and the first synchronization clock signal SCK1.

Each of the second and third timing controllers 220 and 240 may have a structure substantially the same as that of the first timing controller 200. For example, the second timing controller 220 may include a second oscillator, a second PLL, a second synchronization clock signal generator and a second information processor. The second timing controller 220 may generate a second internal reference clock signal IRCK2 based on the reference clock signal RCK, and may generate a second synchronization clock signal SCK2 based on the second internal reference clock signal IRCK2. The third timing controller 240 may include a third oscillator, a third PLL, a third synchronization clock signal generator and a third information processor. The third timing controller 240 may generate a third internal reference clock signal IRCK3 based on the reference clock signal RCK, and may generate a third synchronization clock signal SCK3 based on the third internal reference clock signal IRCK3. Since the second and third timing controllers 220 and 240 operate based on the reference clock signal RCK generated by the first timing controller 200, the second and third oscillators in the second and third timing controllers 220 and 240 may not operate (e.g., may not generate clock signals).

As described above with reference to FIG. 2, the timing controllers 200, 220 and 240 may exchange the plurality of information DI with one another based on the synchronization clock signals SCK1, SCK2 and SCK3. For example, the first timing controller 200 may transmit first information among the plurality of information DI to the second and third timing controllers 220 and 240 based on the first synchronization clock signal SCK1. The second timing controller 220 may perform a data capture operation on the first information based on the first synchronization clock signal SCK1, the second internal reference clock signal IRCK2 and the second synchronization clock signal SCK2. The third timing controller 240 may perform the data capture operation on the first information based on the first synchronization clock signal SCK1, the third internal reference clock signal IRCK3 and the third synchronization clock signal SCK3. The first information processor 218 may perform a data processing operation for the first information, and each of the second and third information processors may perform the data capture operation on the first information.

Figure 6:
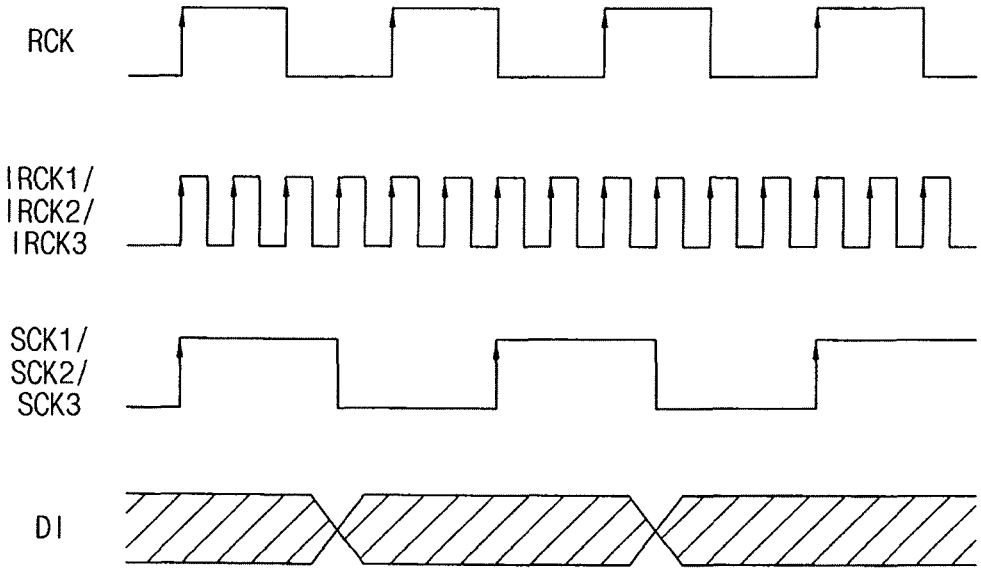
FIG. 6 is a timing diagram for describing a data capture operation performed by the timing controllers according to an exemplary embodiment of the inventive concept.

FIG. 6 is a timing diagram for describing a data capture operation performed by the timing controllers according to an exemplary embodiment of the inventive concept. For example, FIG. 6 describes a data capture operation performed by the timing controllers 200, 220 and 240.

Referring to FIGS. 2, 5 and 6, each of the internal reference clock signals IRCK1, IRCK2 and IRCK3 may be generated based on the reference clock signal RCK. The internal reference clock signals IRCK1, IRCK2 and IRCK3 may have a frequency that is higher than a frequency of the reference clock signal RCK. The frequencies of the internal reference clock signals IRCK1, IRCK2 and IRCK3 may be substantially the same as one another.

Each of the synchronization clock signals SCK1, SCK2 and SCK3 may be generated based on a respective one of the internal reference clock signals IRCK1, IRCK2 and IRCK3. The synchronization clock signals SCK1, SCK2 and SCK3 may have a frequency that is lower than the frequency of each of the internal reference clock signals IRCK1, IRCK2 and IRCK3. The frequencies of the synchronization clock signals SCK1, SCK2 and SCK3 may be substantially the same as one another. Since the plurality of information DI are transmitted based on the synchronization clock signals SCK1, SCK2 and SCK3, a transmission frequency of the plurality of information DI may be substantially the same as the frequency of each of the synchronization clock signals SCK1, SCK2 and SCK3.

In an exemplary embodiment of the inventive concept, the data capture operation for the plurality of information DI may be a multi-phase capture operation. In other words, when the first information among the plurality of information DI is transmitted from the first timing controller 200 to the second and third timing controllers 220 and 240, a single value in the first information may be captured several times based on the second and third internal reference clock signals IRCK2 and IRCK3. Each of the second and third internal reference clock signals IRCK2 and IRCK3 has a frequency higher than the transmission frequency of the plurality of information DI. Thus, the captured value (e.g., the captured data) may have an increased reliability and an increased integrity.

In an exemplary embodiment of the inventive concept, the plurality of information DI may include boundary image data (e.g., data corresponding to a boundary image that is displayed on a boundary region between two adjacent regions among the regions A1, A2 and A3 in FIG. 1), test pattern data, dithering data, data for an inversion driving scheme, data for any synchronization operation, etc.

Although FIG. 6 illustrates an example where the data capture operation is performed based on rising edges of the clock signals, the data capture operation can be performed based on falling edges of the clock signals or based on both rising and falling edges of the clock signals.

FIGS. 7, 8, 9, 10 and 11 are timing diagrams for describing a synchronization of the timing controllers according to an exemplary embodiment of the inventive concept.

Figure 7:
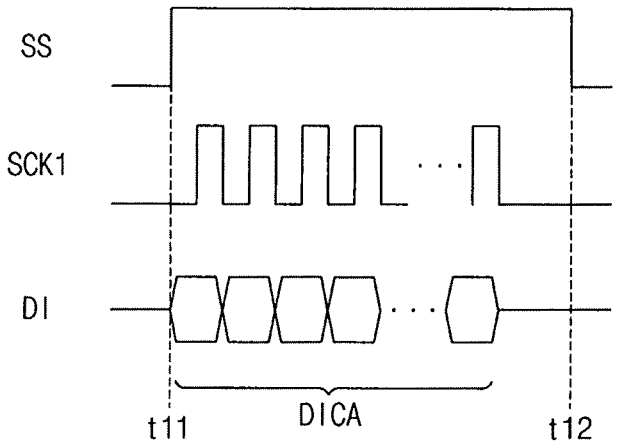
FIGS. 7, 8, 9, 10 and 11 are timing diagrams for describing a synchronization of the timing controllers according to an exemplary embodiment of the inventive concept.

Referring to FIGS. 2 and 7, at time t11, the state synchronization signal SS is activated. During a time in which the state synchronization signal SS is activated, the timing controllers 200, 220 and 240 may exchange the plurality of information DI with one another based on the synchronization clock signals SCK1, SCK2 and SCK3, and thus the timing controllers 200, 220 and 240 may be synchronized with one another.

For example, the first timing controller 200 may transmit information DICA to all of the timing controllers based on the first synchronization clock signal SCK1. In an example of FIG. 7, the information DICA may be common information that is provided from a master timing controller to all of the timing controllers. At time t12 at which the transmission of the information DICA and the synchronization of the timing controllers 200, 220 and 240 are completed, the state synchronization signal SS is deactivated.

Figure 8:
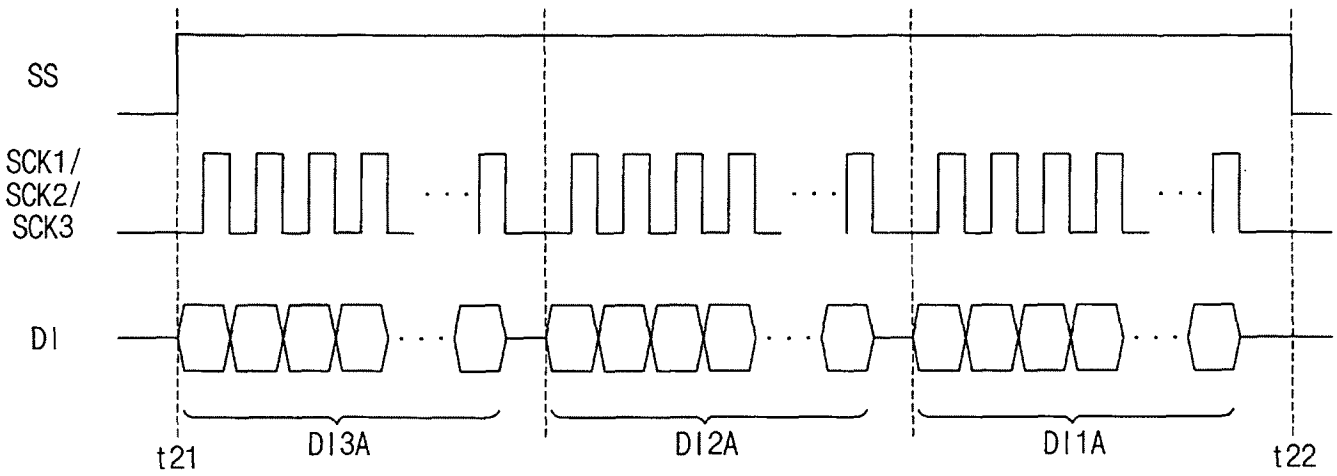

Referring to FIGS. 2 and 8, at time t21, the state synchronization signal SS is activated. The timing controllers 200, 220 and 240 may be synchronized with one another based on the state synchronization signal SS.

For example, the third timing controller 240 may transmit information DI3A to the first and second timing controllers 200 and 220 based on the third synchronization clock signal SCK3. After the transmission of the information DI3A is completed, the second timing controller 220 may transmit information DI2A to the first and third timing controllers 200 and 240 based on the second synchronization clock signal SCK2. After the transmission of the information DI2A is completed, the first timing controller 200 may transmit information DI1A to the second and third timing controllers 220 and 240 based on the first synchronization clock signal SCK1. In an example of FIG. 8, each of the information DI3A, DI2A and DI1A may be information that is individually provided from a single timing controller to the other timing controllers. At time t22 in which the transmission of the information DI3A, DI2A and DI1A and the synchronization of the timing controllers 200, 220 and 240 are completed, the state synchronization signal SS is deactivated.

Figure 9:
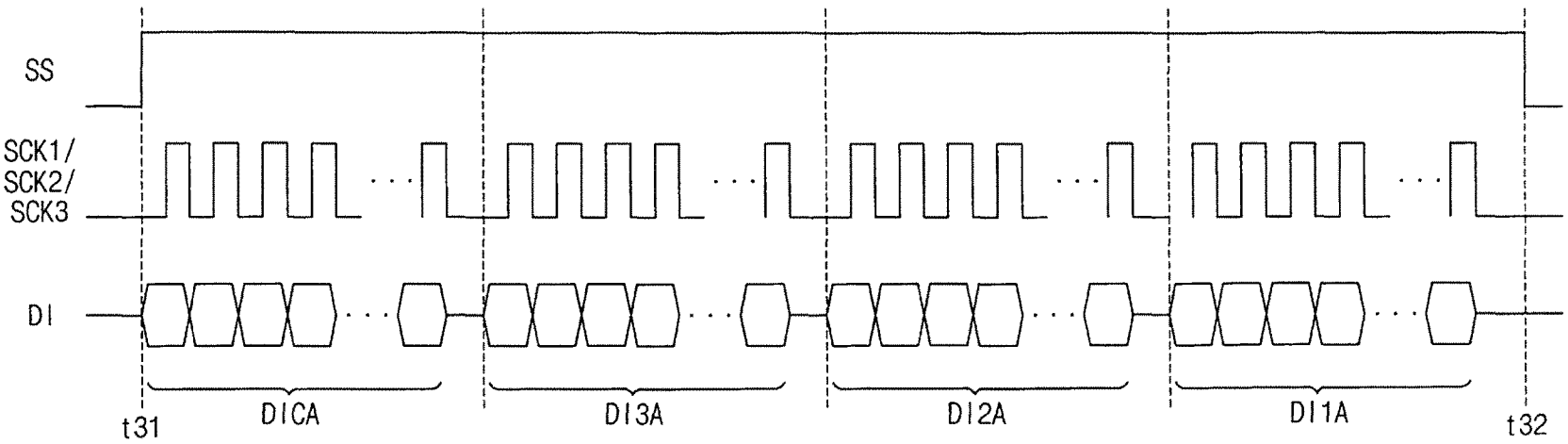

Referring to FIGS. 2 and 9, at time t31, the state synchronization signal SS is activated. The timing controllers 200, 220 and 240 may be synchronized with one another based on the state synchronization signal SS. An example of FIG. 9 may be a combination of the example of FIG. 7 and the example of FIG. 8.

For example, the first timing controller 200 may transmit the information DICA to all of the timing controllers based on the first synchronization clock signal SCK1. The third timing controller 240 may transmit the information DI3A to the first and second timing controllers 200 and 220 based on the third synchronization clock signal SCK3. The second timing controller 220 may transmit the information DI2A to the first and third timing controllers 200 and 240 based on the second synchronization clock signal SCK2. The first timing controller 200 may transmit the information DI1A to the second and third timing controllers 220 and 240 based on the first synchronization clock signal SCK1. At time t32 in which the transmission of the information DICA, DI3A, DI2A and DI1A and the synchronization of the timing controllers 200, 220 and 240 are completed, the state synchronization signal SS is deactivated.

Figure 10:
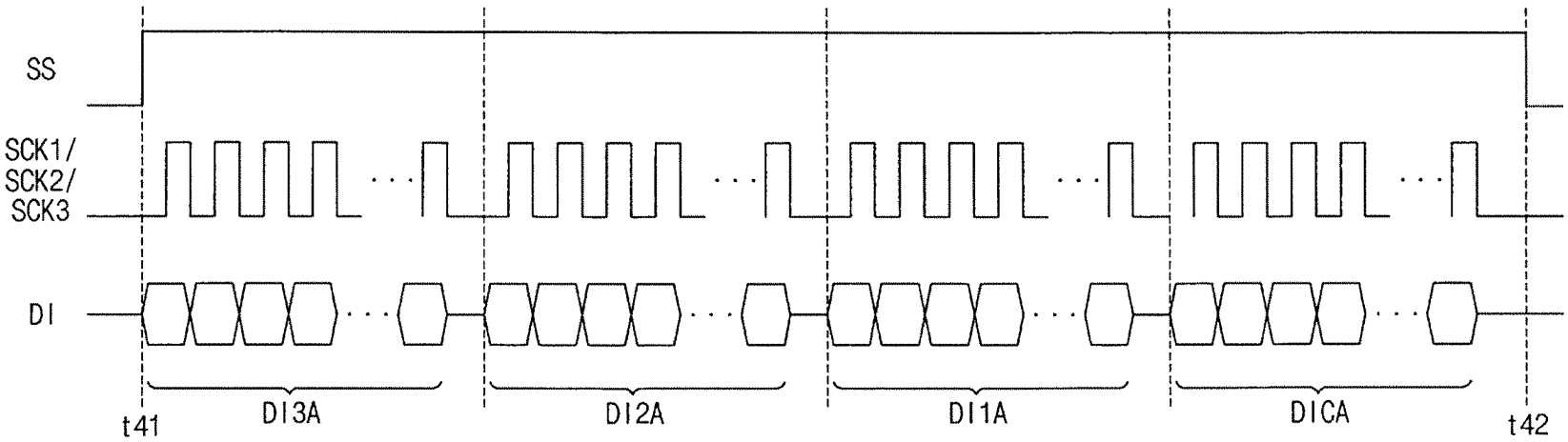

Referring to FIGS. 2 and 10, at time t41, the state synchronization signal SS is activated. The timing controllers 200, 220 and 240 may be synchronized with one another based on the state synchronization signal SS. FIG. 10 may be a combination of the example of FIG. 8 and the example of FIG. 7.

For example, the third timing controller 240 may transmit the information DI3A to the first and second timing controllers 200 and 220 based on the third synchronization clock signal SCK3. The second timing controller 220 may transmit the information DI2A to the first and third timing controllers 200 and 240 based on the second synchronization clock signal SCK2. The first timing controller 200 may transmit the information DI1A to the second and third timing controllers 220 and 240 based on the first synchronization clock signal SCK1. The first timing controller 200 may transmit the information DICA to all of the timing controllers based on the first synchronization clock signal SCK1. At time t42 in which the transmission of the information DI3A, DI2A, DI1A and DICA and the synchronization of the timing controllers 200, 220 and 240 are completed, the state synchronization signal SS is deactivated.

In an exemplary embodiment of the inventive concept, each of a time duration from time t11 to time t12 in FIG. 7, a time duration from time t21 to time t22 in FIG. 8, a time duration from time t31 to time t32 in FIG. 9, and a time duration from time t41 to time t42 in FIG. 10 may be substantially the same as a time duration from time t3 to time t5 in FIG. 4.

Although the transmission of information between the timing controllers 200, 220 and 240 and the synchronization of the timing controllers 200, 220 and 240 are described based on the examples of FIGS. 7, 8, 9 and 10, the transmission and the synchronization of the timing controllers 200, 220 and 240 can be performed based on other various schemes.

Figure 11:
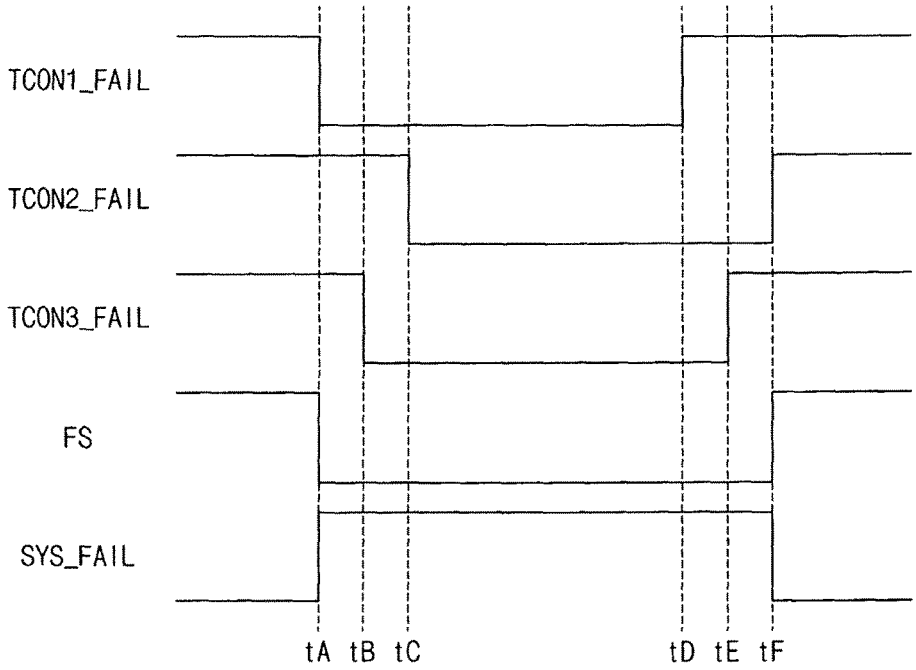

Referring to FIGS. 2 and 11, when at least one of the timing controllers 200, 220 and 240 enters the fail mode, the fail synchronization signal FS may be activated. The display apparatus 10 of FIG. 1 may enter a system fail mode based on the fail synchronization signal FS. When the timing controllers 200, 220 and 240 leave the fail mode, the display apparatus 10 may leave the system fail mode.

For example, at time tA, the first timing controller 200 complies with a fail mode enable condition to enter the fail mode, and a pin (e.g., a SYNC_D1 pin) that is associated with the fail synchronization signal FS and in the first timing controller 200 is driven to have a logic low level (e.g., TCON1_FAIL=logic low level). The fail synchronization signal FS is activated (e.g., FS=logic low level) based on the TCON1_FAIL, and the display apparatus 10 enters the system fail mode (e.g., SYS_FAIL=logic high level). The second and third timing controllers 220 and 240 recognize, based on the fail synchronization signal FS, that the first timing controller 200 has entered the fail mode and the display apparatus 10 has entered the system fail mode.

At time tB, the third timing controller 240 enters the fail mode, and a pin that is associated with the fail synchronization signal FS and in the third timing controller 240 is driven to have the logic low level (e.g., TCON3_FAIL=logic low level). At time tC, the second timing controller 220 enters the fail mode, and a pin that is associated with the fail synchronization signal FS and in the second timing controller 220 is driven to have the logic low level (e.g., TCON2_FAIL=logic low level). At time tD, the first timing controller 200 escapes (e.g., exits) from the fail mode, and the pin that is associated with the fail synchronization signal FS and in the first timing controller 200 is released (e.g., TCON1_FAIL=HI-Z level). At time tE, the third timing controller 240 escapes from the fail mode, and the pin that is associated with the fail synchronization signal FS and in the third timing controller 240 is released (e.g., TCON3_FAIL=HI-Z level). The fail synchronization signal FS is maintained at an activation level, and the display apparatus 10 maintains the system fail mode until the timing controllers 200, 220 and 240 escape from the fail mode.

At time tF, the second timing controller 220 escapes from the fail mode, and the pin that is associated with the fail synchronization signal FS and in the second timing controller 220 is released (e.g., TCON2_FAIL=HI-Z level). When the timing controllers 200, 220 and 240 escape from the fail mode (e.g., at time tF TCON1_FAIL, TCON2_FAIL and TCON3_FAIL have the HI-Z level), the fail synchronization signal FS is deactivated (e.g., FS=logic high level), and the display apparatus 10 escapes from the system fail mode (e.g., SYS_FAIL=logic low level).

Figure 12:
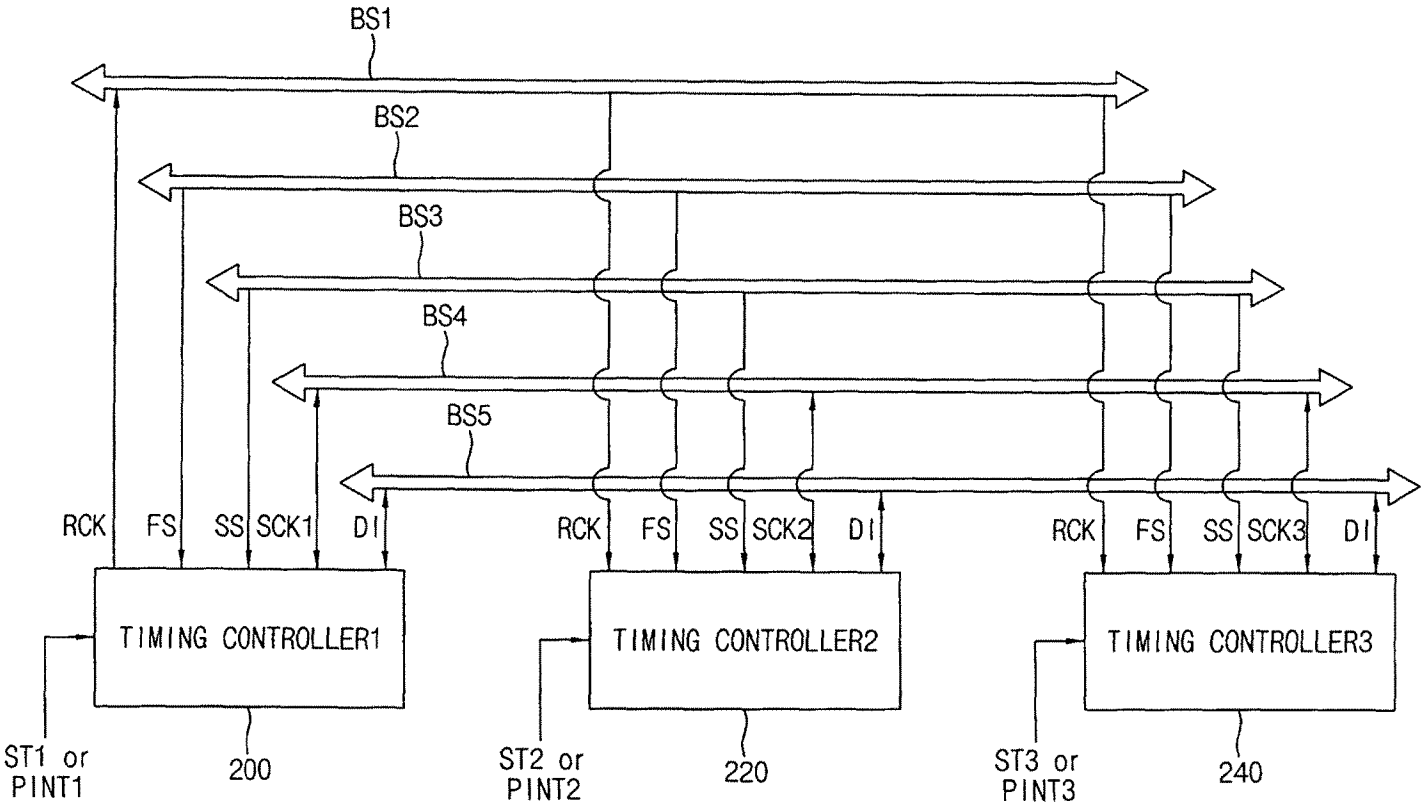
FIGS. 12 and 13 are block diagrams illustrating timing controllers included in the display apparatus according to an exemplary embodiment of the inventive concept.
Figure 13:
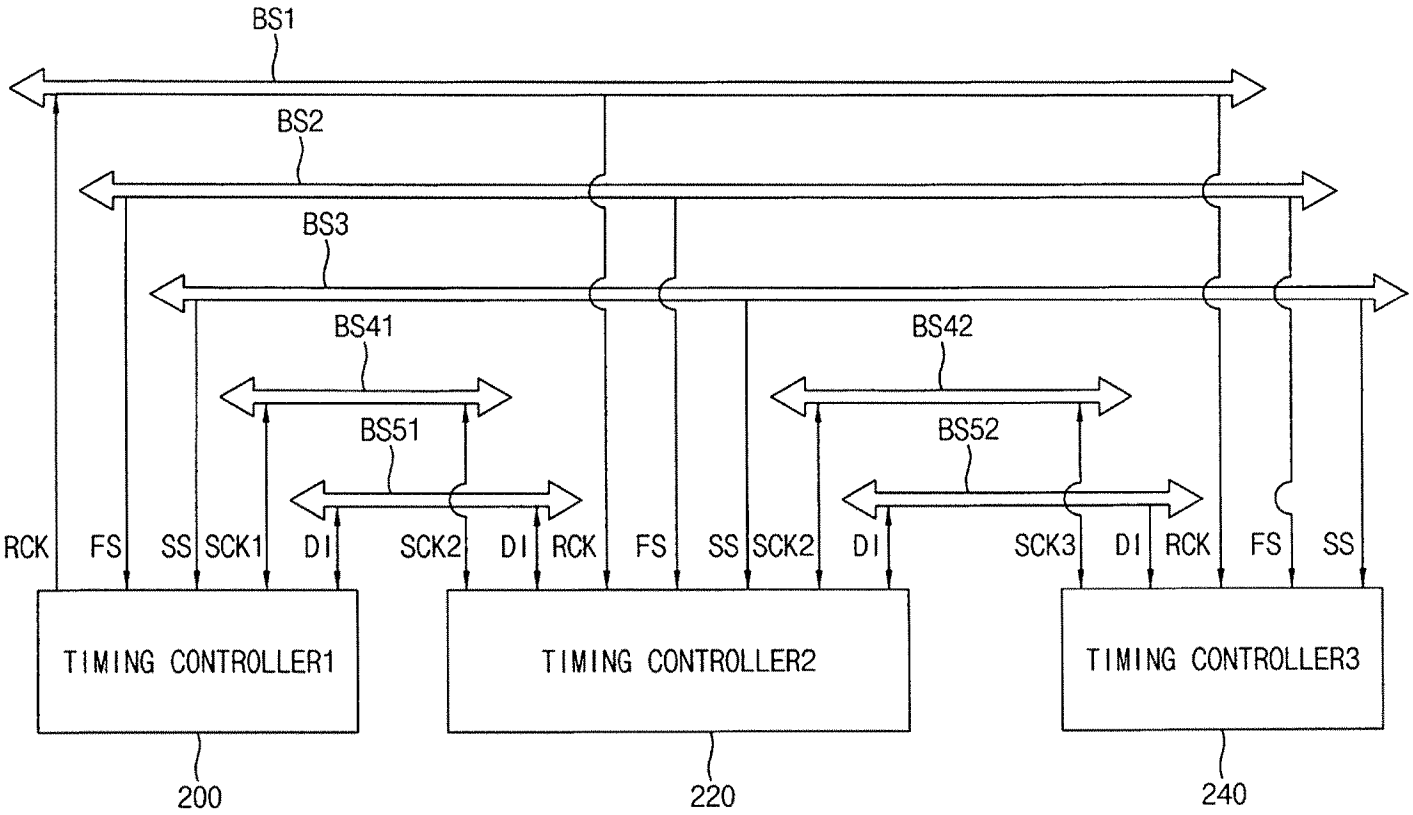

FIGS. 12 and 13 are block diagrams illustrating timing controllers included in the display apparatus according to an exemplary embodiment of the inventive concept.

Referring to FIG. 12, the first timing controller 200 may operate as the master, the second timing controller 220 may operate as the first slave, and the third timing controller 240 may operate as the second slave.

The timing controllers 200, 220 and 240 in FIG. 12 may be substantially the same as the timing controllers 200, 220 and 240 in FIG. 2, respectively, except that the timing controllers 200, 220 and 240 in FIG. 12 operate based on setting signals ST1, ST2 and ST3, or based on internal parameters PINT1, PINT2 and PINT3.

In an exemplary embodiment of the inventive concept, the first timing controller 200 may receive the first setting signal ST1 for selecting the first timing controller 200 as the master. The second timing controller 220 may receive the second setting signal ST2 for selecting the second timing controller 220 as the first slave. The third timing controller 240 may receive the third setting signal ST3 for selecting the third timing controller 240 as the second slave. For example, the setting signals ST1, ST2 and ST3 may be received from an external device.

In an exemplary embodiment of the inventive concept, the first timing controller 200 may be selected as the master based on the first internal parameter PINT1. The second timing controller 220 may be selected as the first slave based on the second internal parameter PINT2. The third timing controller 240 may be selected as the second slave based on the third internal parameter PINT3. For example, the internal parameters PINT1, PINT2 and PINT3 may not be received from an external device. The internal parameters PINT1, PINT2 and PINT3 may be stored in a storage device (e.g., an EEPROM) in the display apparatus 10 of FIG. 1, and may be loaded from the storage device.

Referring to FIG. 13, the timing controllers 200, 220 and 240 are synchronized with one another based on the reference clock signal RCK, and are additionally synchronized with one another based on the state synchronization signal SS. The reference clock signal RCK may be shared by the timing controllers 200, 220 and 240 by using the single bus BS1. The state synchronization signal SS may be shared by the timing controllers 200, 220 and 240 by using the single bus BS3. The fail synchronization signal FS may be shared by the timing controllers 200, 220 and 240 by using the single bus BS2.

The timing controllers 200, 220 and 240 in FIG. 13 may be substantially the same as the timing controllers 200, 220 and 240 in FIG. 2, respectively, except for the single buses for transmitting the synchronization clock signals SCK1, SCK2 and SCK3 and the plurality of information DI are different from the single buses BS4 and BS5 in FIG. 2.

The first and second synchronization clock signals SCK1 and SCK2 may be shared by the first and second timing controllers 200 and 220 by using a bus BS41. The plurality of information DI may be shared by the first and second timing controllers 200 and 220 by using a bus BS51. The second and third synchronization clock signals SCK2 and SCK3 may be shared by the second and third timing controllers 220 and 240 by using a bus BS42. The plurality of information DI may be shared by the second and third timing controllers 220 and 240 by using a bus BS52. In other words, the synchronization clock signals SCK1, SCK2 and SCK3 and the plurality of information DI may be shared by the timing controllers 200, 220 and 240 based on a relay scheme. In the relay scheme at least one of the synchronization clock signals SCK1, SCK2 and SCK3 and the plurality of information DI are relayed between two adjacent timing controllers among the timing controllers 200, 220 and 240.

Figure 14:
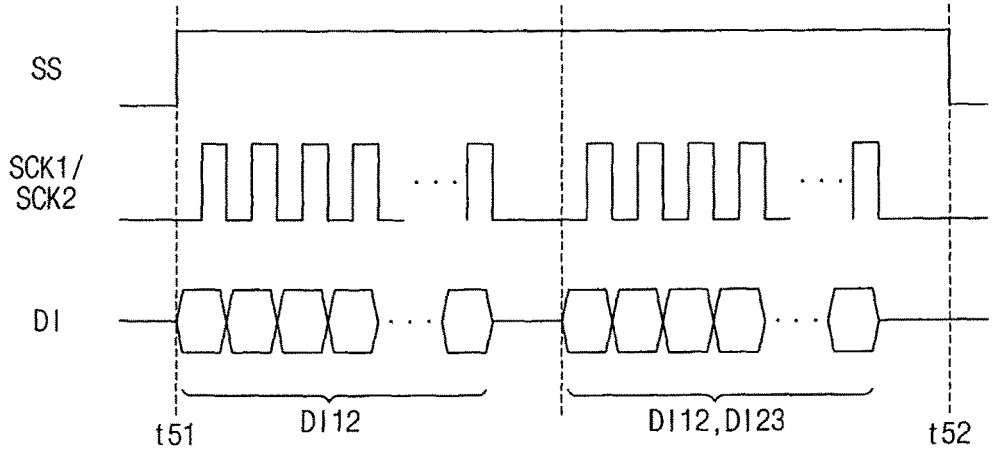
FIGS. 14 and 15 are timing diagrams for describing a synchronization of the timing controllers according to an exemplary embodiment of the inventive concept.
Figure 15:
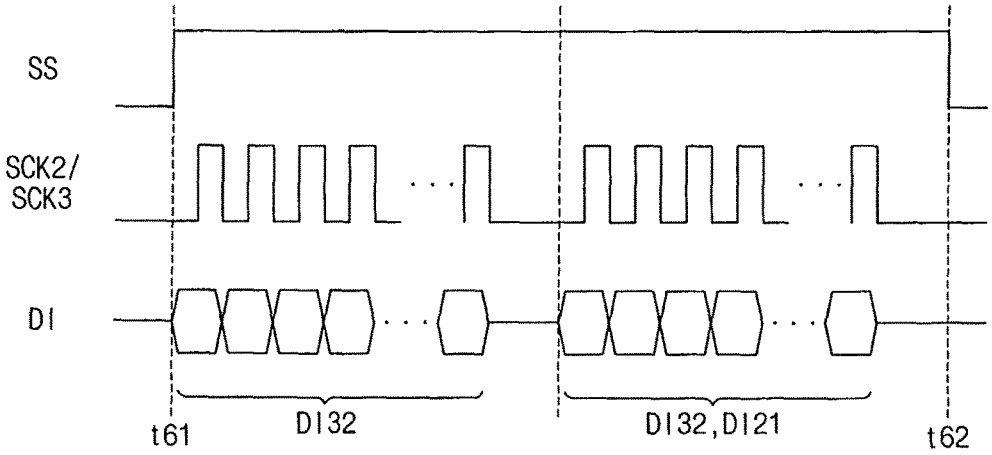

FIGS. 14 and 15 are timing diagrams for describing a synchronization of the timing controllers according to an exemplary embodiment of the inventive concept.

Referring to FIGS. 13 and 14, at time t51, the state synchronization signal SS is activated. During a time duration in which the state synchronization signal SS is activated, the timing controllers 200, 220 and 240 may exchange the plurality of information DI with one another based on the synchronization clock signals SCK1, SCK2 and SCK3, and thus the timing controllers 200, 220 and 240 may be synchronized with one another.

For example, the first timing controller 200 may transmit information DI12 to the second timing controller 220 based on the first synchronization clock signal SCK1. After the transmission of the information DI12 is completed, the second timing controller 220 may transmit the information DI12 and information DI23 to the third timing controller 240 based on the second synchronization clock signal SCK2. In an example of FIG. 14, each of the information DI12 and DI23 may be information that is individually provided from one timing controller to another timing controller. At time t52 in which the transmission of the information DI12 and DI23 and the synchronization of the timing controllers 200, 220 and 240 are completed, the state synchronization signal SS is deactivated.

Referring to FIGS. 13 and 15, at time t61, the state synchronization signal SS is activated. The timing controllers 200, 220 and 240 may be synchronized with one another based on the state synchronization signal SS.

For example, the third timing controller 240 may transmit information DI32 to the second timing controller 220 based on the third synchronization clock signal SCK3. After the transmission of the information DI32 is completed, the second timing controller 220 may transmit the information DI32 and information DI21 to the first timing controller 200 based on the second synchronization clock signal SCK2. In an example of FIG. 15, each of the information DI32 and DI21 may be information that is individually provided from one timing controller to another timing controller. At time t62 in which the transmission of the information DI32 and DI21 and the synchronization of the timing controllers 200, 220 and 240 are completed, the state synchronization signal SS is deactivated.

In an exemplary embodiment of the inventive concept, each of a time duration from time t51 to time t52 in FIG. 14, and a time duration from time t61 to time t62 in FIG. 15 may be substantially the same as the time duration from time t3 to time t5 in FIG. 4.

Although the transmission of information between the timing controllers 200, 220 and 240 and the synchronization of the timing controllers 200, 220 and 240 are described based on the examples of FIGS. 14 and 15, the transmission and the synchronization of the timing controllers 200, 220 and 240 can be performed based on one of various schemes.

Figure 16:
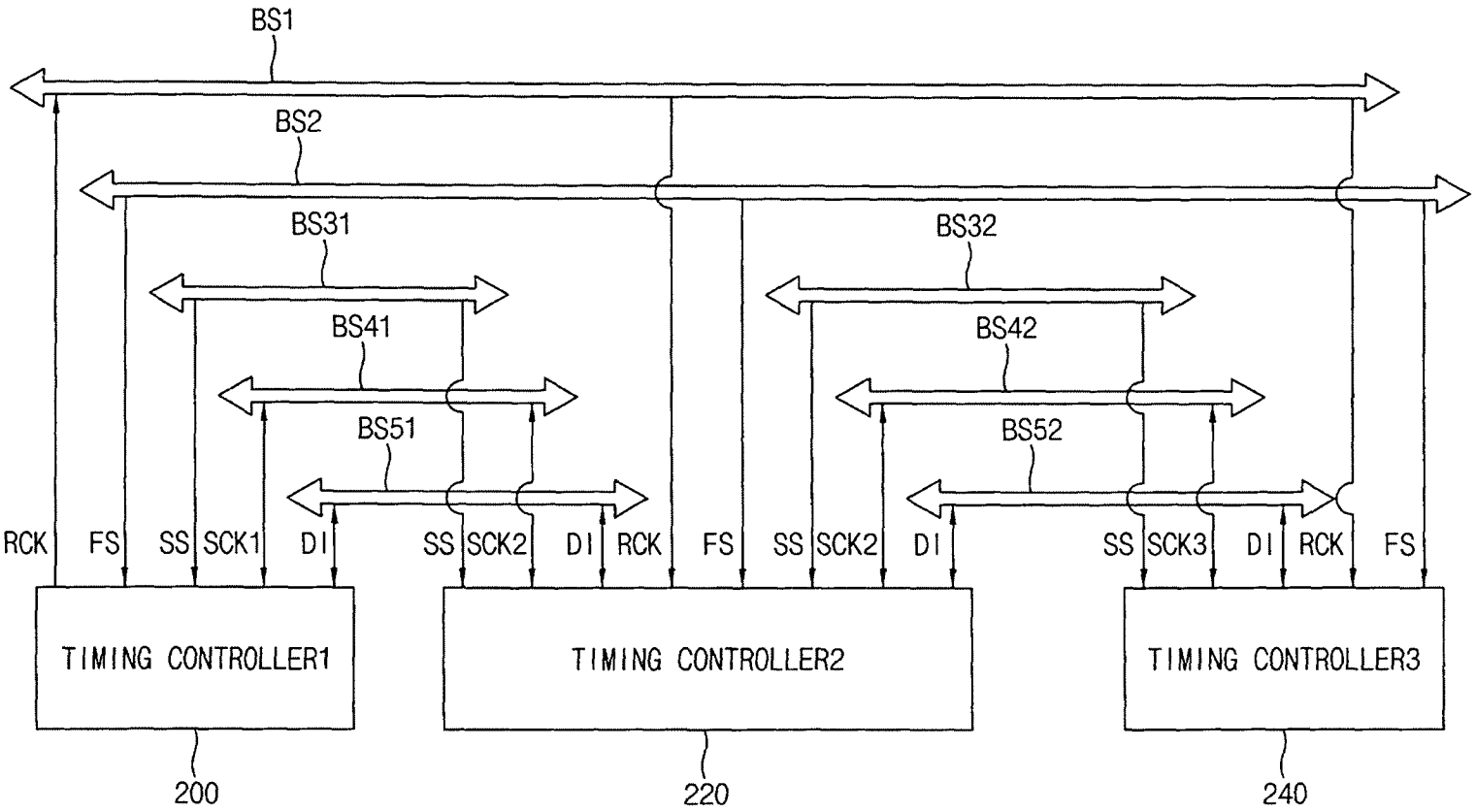
FIG. 16 is a block diagram illustrating timing controllers included in the display apparatus according to an exemplary embodiment of the inventive concept.

FIG. 16 is a block diagram illustrating timing controllers included in the display apparatus according to an exemplary embodiment of the inventive concept.

Referring to FIG. 16, the timing controllers 200, 220 and 240 are synchronized with one another based on the reference clock signal RCK, and are additionally synchronized with one another based on the state synchronization signal SS. The reference clock signal RCK may be shared by the timing controllers 200, 220 and 240 by using the single bus BS1. The fail synchronization signal FS may be shared by the timing controllers 200, 220 and 240 by using the single bus BS2.

The timing controllers 200, 220 and 240 in FIG. 16 may be substantially the same as the timing controllers 200, 220 and 240 in FIG. 13, respectively, except that a configuration for transmitting the state synchronization signal SS is different from the single bus BS3 in FIG. 13.

The state synchronization signal SS may be shared by the first and second timing controllers 200 and 220 based on a bus BS31. The state synchronization signal SS may be shared by the second and third timing controllers 220 and 240 based on a bus BS32. In other words, the state synchronization signal SS may be shared by the timing controllers 200, 220 and 240 based on the relay scheme. In the relay scheme the state synchronization signal SS is relayed between two adjacent timing controllers among the timing controllers 200, 220 and 240.

In a further example, one of the second and third timing controllers 220 and 240 can operate as the master, and the other timing controllers can operate as the slaves. The timing controller that is set as the master may generate the reference clock signal RCK.

Figure 17:
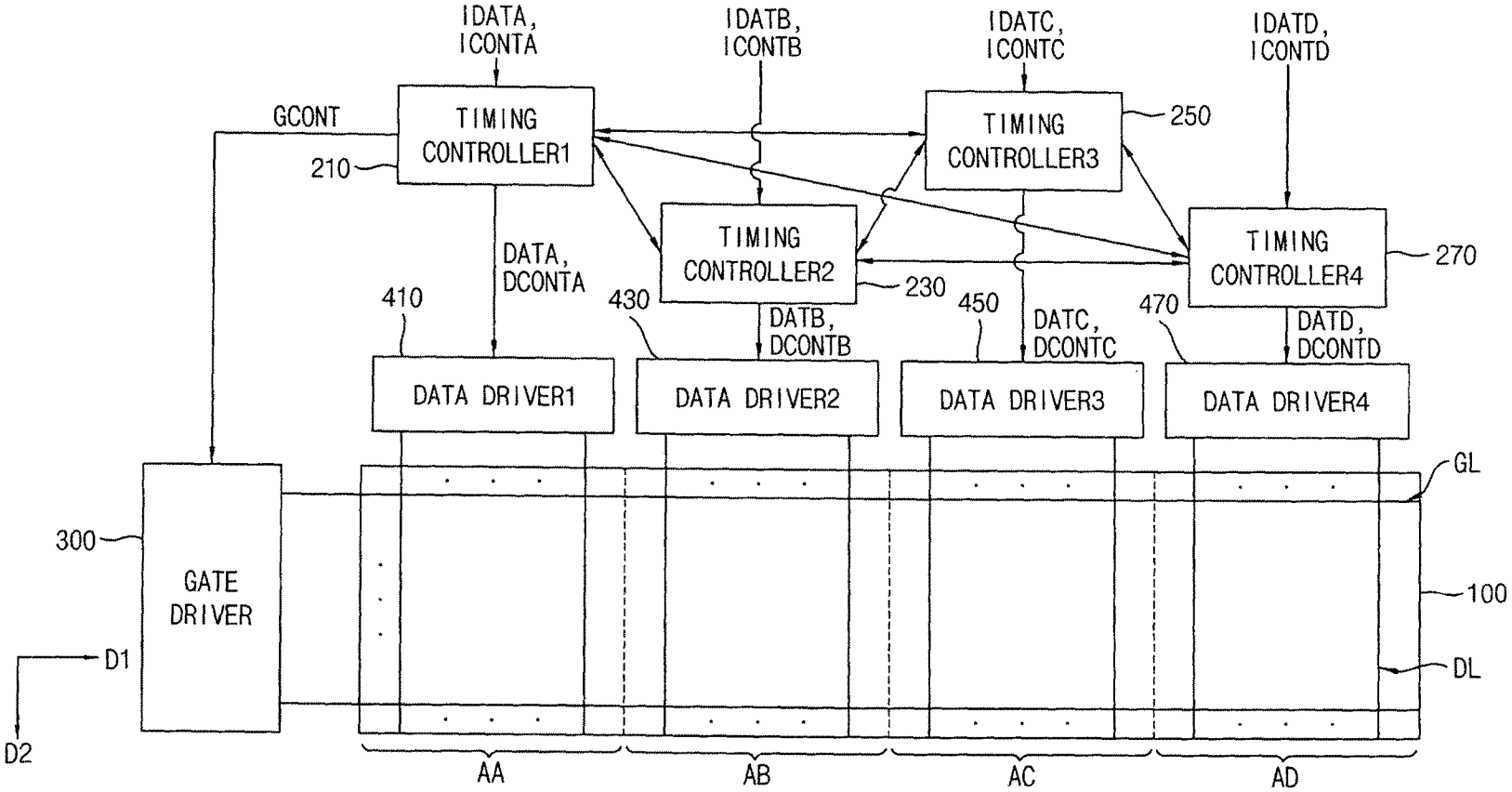
FIG. 17 is a block diagram illustrating a display apparatus according to an exemplary embodiment of the inventive concept.

FIG. 17 is a block diagram illustrating a display apparatus according to an exemplary embodiment of the inventive concept.

Referring to FIG. 17, a display apparatus 10*a* includes a display panel 100, first, second, third and fourth timing controllers 210, 230, 250 and 270, a gate driver 300, and first, second, third and fourth data drivers 410, 430, 450 and 470.

The display apparatus 10*a* of FIG. 17 may be substantially the same as the display apparatus 10 of FIG. 1, except that the display panel 100 in FIG. 17 is divided into four display regions, and then the display apparatus 10*a* of FIG. 17 includes four timing controllers and four data drivers.

The display panel 100 operates based on first, second, third and fourth output image data DATA, DATB, DATC and DATD. The display panel 100 may include first, second, third and fourth regions AA, AB, AC and AD. The timing controllers 210, 230, 250 and 270 receive first, second, third and fourth input image data IDATA, IDATB, IDATC and IDATD, and first, second, third and fourth input control signals ICONTA, ICONTB, ICONTC and ICONTD from an external device. The timing controllers 210, 230, 250 and 270 generate the output image data DATA, DATB, DATC and DATD, and first, second, third, fourth and fifth control signals GCONT, DCONTA, DCONTB, DCONTC and DCONTD based on the input image data IDATA, IDATB, IDATC and IDATD, and the input control signals ICONTA, ICONTB, ICONTC and ICONTD. The gate driver 300 generates a plurality of gate signals based on the first control signal GCONT. The data drivers 410, 430, 450 and 470 generate a plurality of analog data voltages based on the second, third, fourth and fifth control signals DCONTA, DCONTB, DCONTC and DCONTD and the digital output image data DATA, DATB, DATC and DATD.

One of the timing controllers 210, 230, 250 and 270 generates a reference clock signal RCK, and others of the timing controllers 210, 230, 250 and 270 receive the reference clock signal RCK. The timing controllers 210, 230, 250 and 270 are synchronized with one another based on the reference clock signal RCK. The timing controllers 210, 230, 250 and 270 operate in one of a plurality of states depending on an operation of the display apparatus 10*a*. The timing controllers 210, 230, 250 and 270 are additionally synchronized with one another based on a state synchronization signal SS.

Figure 18:
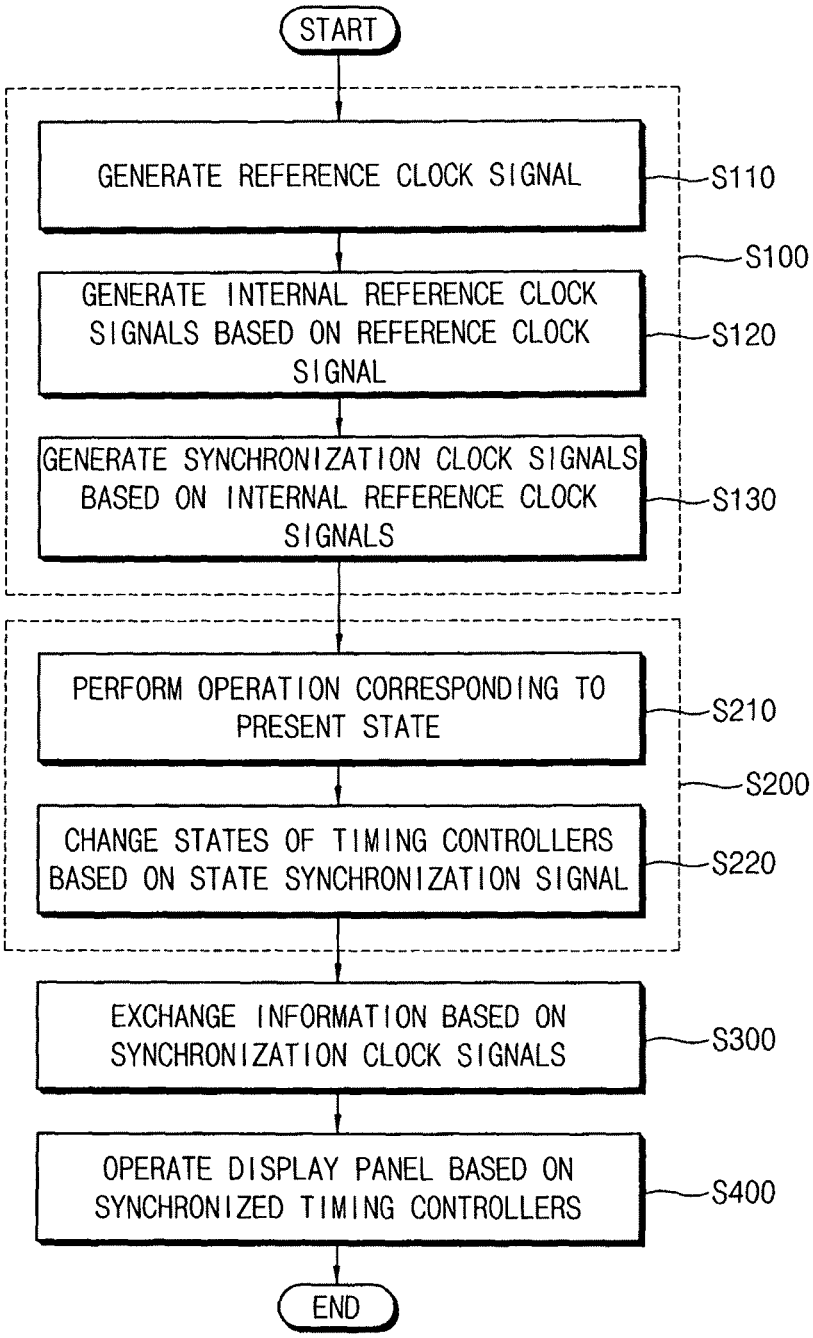
FIG. 18 is a flow chart illustrating a method of operating a display apparatus according to an exemplary embodiment of the inventive concept.

FIG. 18 is a flow chart illustrating a method of operating a display apparatus according to an exemplary embodiment of the inventive concept.

Referring to FIGS. 1, 2 and 18, in the method of operating the display apparatus 10 according to an exemplary embodiment of the inventive concept, the timing controllers 200, 220 and 240 are synchronized with one another based on the reference clock signal RCK (step S100). The timing controllers 200, 220 and 240 control the operations of the regions A1, A2 and A3 in the display panel 100, respectively. For example, the timing controller 200, operating as the master, may generate the reference clock signal RCK (step S110). The timing controllers 200, 220 and 240 may generate the internal reference clock signals IRCK1, IRCK2 and IRCK3 based on the reference clock signal RCK (step S120). The timing controllers 200, 220 and 240 may generate the synchronization clock signals SCK1, SCK2 and SCK3 based on the internal reference clock signals IRCK1, IRCK2 and IRCK3 (step S130).

The timing controllers 200, 220 and 240 are additionally synchronized with one another based on the state synchronization signal SS (step S200). For example, each of the timing controllers 200, 220 and 240 may operate in one of the plurality of states depending on the operation of the display apparatus 10. Each of the timing controllers 200, 220 and 240 may perform an operation (e.g., the first operation) corresponding to a present state (e.g., the first state) (step S210). When the timing controllers 200, 220 and 240 complete the operation corresponding to the present state, the state of each of the timing controllers 200, 220 and 240 may be changed (e.g., changed from the first state to the second state) based on the state synchronization signal SS (step S220). For example, the states of the timing controllers 200, 220 and 240 may be changed based on the example of FIGS. 3 and 4.

The timing controllers 200, 220 and 240 exchange the plurality of information DI associated with the operation of the display apparatus 10 with one another based on the state synchronization signal SS and the synchronization clock signals SCK1, SCK2 and SCK3 (step S300). For example, the plurality of information DI may be exchanged based on the examples of FIGS. 5, 6, 7, 8, 9, 10, 14 and 15. For example, the plurality of information DI may include the boundary image data, the test pattern data, the dithering data, the data for the inversion driving scheme, the data for any synchronization operation, etc.

The display panel 100 operates based on the synchronized timing controllers 200, 220 and 240 (step S400).

Although FIG. 18 illustrates steps S100, S200, S300 and S400 as being sequentially performed, at least two of steps S100, S200, S300 and S400 in FIG. 18 may be performed at substantially the same time. For example, two timing controllers may receive a signal substantially at the same time and perform an action at substantially the same time. In a further example, a first timing controller may receive a signal before a second timing controller receives a signal. In this example, the first timing controller may perform an action before the second timing controller or wait and perform the action at substantially at the same time as the second timing controller.

Although the above exemplary embodiments of the inventive concept describe examples where the display apparatus includes three or four timing controllers, an exemplary embodiment of the inventive concept may include a plurality of timing controllers to be synchronized with one another. In an exemplary embodiment of the inventive concept, the display apparatus may include N timing controllers and N data drivers and N display regions. In this example the display apparatus may include one gate driver. N is an integer greater than 1.

The above described embodiments may be used in a display apparatus and/or a system including the display apparatus, such as a mobile phone, a smart phone, a personal digital assistant (PDA), a portable multimedia player (PMP), a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of an exemplary embodiment of the inventive concept and is not to be construed as limiting thereof. Although a few exemplary embodiments of the inventive concept have been described, those skilled in the art will readily appreciate that many modifications are possible. Accordingly, all such modifications are intended to be included within the scope of the present inventive concept. Therefore, it is to be understood that the foregoing is illustrative of various exemplary embodiments of the inventive concept and is not to be construed as limited to the exemplary embodiments of the inventive concept disclosed.

What is claimed is:

1. A display apparatus, comprising:

a display panel;

a first timing controller configured to control an operation of a first region in the display panel, and configured to generate a reference clock signal;

a second timing controller configured to control an operation of a second region in the display panel, and configured to receive the reference clock signal; and a third timing controller configured to control an operation of a third region in the display panel, and configured to receive the reference clock signal, wherein the first, second and third timing controllers are configured to be synchronized with one another in response to the reference clock signal and a state synchronization signal, wherein the first, second and third timing controllers are configured to operate in one of a plurality of states depending on an operation of the display apparatus by using the state synchronization signal, wherein when each of the first, second and third timing controllers operates in a first state, each of the first, second and third timing controllers performs a first operation corresponding to the first state, wherein a first pin of the first timing controller associated with the state synchronization singal is released and has a first logic level when the first timing controller completes the first operation, a second pin of the second timing controller associated with the state synchronization sigal is released and has the first logic level when the second timing controller completes the first operation, and a third pin of the third timing controller associated with the state synchronization signal is released and has the first logic level when the third timing controller completes the first operation, and wherein the state synchronization signal is actvated when the first pin, the second pin, and the third pin have the first logic level.

2. The display apparatus of claim 1, wherein when the first, second and third timing controllers complete the first operation, a state of each of the first, second and third timing controllers is changed from the first state to a second state in response to the state synchronization signal.

3. The display apparatus of claim 2, wherein when the first, second and third timing controllers complete the first operation, the state synchronization signal is activated, wherein when a first time interval is elapsed after the state synchronization signal is activated, the state of each of the first, second and third timing controllers is changed from the first state to the second state, wherein when a second time interval is elapsed after the state of the first, second and third timing controllers is changed from the first state to the second state, the state synchronization signal is deactivated, and wherein the first time interval and the second time interval are determined by the reference clock signal.

4. The display apparatus of claim 1, wherein the reference clock signal is shared by the first, second and third timing controllers in a broadcasting scheme, and in the broadcasting scheme the reference clock signal is generated by one of the first, second and third timing controllers and transmitted to the other timing controllers.

5. The display apparatus of claim 1, wherein the state synchronization signal is shared by the first, second and third timing controllers by using a single bus, or wherein the state synchronization signal is relayed between two adjacent timing controllers.

6. The display apparatus of claim 1, wherein the first timing controller is configured to generate a first internal reference clock signal in response to the reference clock signal, and configured to generate a first synchronization clock signal in response to the first internal reference clock signal, wherein the second timing controller is configured to generate a second internal reference clock signal in response to the reference clock signal, and configured to generate a second synchronization clock signal in response to the second internal reference clock signal, wherein the third timing controller is configured to generate a third internal reference clock signal in response to the reference clock signal, and configured to generate a third synchronization clock signal in response to the third internal reference clock signal, and wherein the first, second and third timing controllers are configured to exchange a plurality of information associated with the operation of the display apparatus with one another in response to the first, second and third synchronization clock signals.

7. The display apparatus of claim 6, wherein the first timing controller is configured to transmit first information of the plurality of information to the second and third. timing controllers in response to the first synchronization clock signals.

8. The display apparatus of claim 7, wherein the second timing controller is configured to perform a data capture operation on the first information in response to the second internal reference clock signal, and wherein the third timing controller is configured to perform the data capture operation on the first information in response to the third internal reference clock signal.

9. The display apparatus of claim 8, wherein each of the first, second and third internal reference clock signals has a frequency higher than a frequency of the reference clock signal, wherein each of the first, second and third synchronization clock signals has a frequency lower than the frequency of each of the first, second and third internal reference clock signals, and wherein the data capture operation includes a multi-phase capture operation.

10. The display apparatus of claim 6, wherein the third timing controller is configured to transmit first information of the plurality of information to the first and second timing controllers in response to the third synchronization clock signal, wherein the second timing controller is configured to transmit second information of the plurality of information to the first and third timing controllers in response to the second synchronization clock signal, and wherein the first timing controller is configured to transmit third information of the plurality of information to the second and third timing controllers in response to the first synchronization clock signal.

11. The display apparatus of claim 6, wherein the first timing controller is configured to transmit first information of the plurality of information to the second timing controller in response to the first synchronization clock signal, and wherein the second timing controller is configured to transmit the first information and second information of the plurality of information to the third timing controller in response to the second synchronization clock signal.

12. The display apparatus of claim 6, wherein the first, second and third synchronization clock signals are shared by the first, second and third timing controllers by using a first bus, and the plurality of information are shared by the first, second and third timing controllers by using a second bus, or wherein at least one of the first, second and third synchronization clock signals and the plurality of information are relayed between two adjacent timing controllers.

13. The display apparatus of claim 1, wherein the first timing controller is configured to operate as a master, the second timing controller is configured to operate as a first slave, and the third timing controller is configured to operate as a second slave.

14. The display apparatus of claim 13, wherein the first timing controller is configured to receive a first setting signal indicating the first timing controller is the master, wherein the second timing controller is configured to receive a second setting signal indicating the second timing controller is the first slave, and wherein the third timing controller is configured to receive a third setting signal indicating the third timing controller is the second slave.

15. The display apparatus of claim 13, wherein the first timing controller is configured to be the master based on a first internal parameter, wherein the second timing controller is configured to be the first slave based on a second internal parameter, and wherein the third timing controller is configured to be the second slave based on a third internal parameter.

16. The display apparatus of claim 1, further comprising:

a fourth timing controller configured to control an operation of a fourth region in the display panel, and configured to receive the reference clock signal, wherein the fourth timing controller is configured to operate in one of the plurality of states depending on the operation of the display apparatus, and wherein the fourth timing controller configured to be synchronized with the first, second and third timing controllers based on the reference dock signal and the state synchronization signal.

17. A method of operating a display apparatus, the method comprising:

synchronizing first, second and third timing controllers with each other by using a reference clock signal and a state synchronization signal; and operating a display panel by using the first, second and third timing controllers, wherein the first, second and third timing controllers are configured to control operations of first, second and third regions in the display panel, respectively, and are configured to operate in one of a plurality of states depending on an operation of the display apparatus, wherein the plurality of states includes a first state and a second, wherein the state synchronization signal is activated to change from the first state to the second state and is deactivated after a predetermined amount of time, and wherein after changing to the second state and deactivating the state synchonization signal, the first, second and the third timing controllers continue to operate in the second state.

18. The method of claim 17, wherein synchronizing the first, second and third timing controllers with each other by using the state synchronization signal includes:

when each of the first, second and third timing controllers are in the first state, performing, by each of the first, second and third timing controllers, a first operation corresponding to the first state; and when the first, second and third timing controllers complete the first operation, change a state of each of the first, second and third timing controllers from the first state to the second state by using the state synchronization signal.

19. The method of claim 18, Wherein changing the state of each of the first, second and third timing controllers includes:

when the first, second and third timing controllers complete the first operation, activating the state synchronization signal;

when a first time interval elapses after the state synchronization signal is activated, changing the state of each of the first, second and third timing controllers from the first state to the second state; and when a second time interval elapses after the state of each of the first, second and third timing controllers changes from the first state to the second state, deactivating the state synchronization signal, and wherein the first time interval and the second time interval are determined by the reference clock signal.

20. The method of claim 17, wherein synchronizing the first, second and third timing controllers with each other by using the reference clock signal includes:

generating the reference clock signal;

generating first, second and third internal reference clock signals by using the reference clock signal; and generating first, second and third synchronization clock signals by using the first, second and third internal reference clock signals, and wherein the first, second and third timing controllers are configured to exchange a plurality of information associated with the operation of the display apparatus with each other by using the first, second and third synchronization clock signals.

* * * * *